US006672323B2

(12) United States Patent
Gupta et al.

(10) Patent No.: US 6,672,323 B2
(45) **Date of Patent: *Jan. 6, 2004**

(54) MULTI-PURPOSE SELF-ERECTING STRUCTURE HAVING ADVANCED INSECT PROTECTION AND STORAGE CHARACTERISTICS

(75) Inventors: Raj Kumar Gupta, Walkersville, MD (US); Young Woo Yoon, Glenview, IL (US)

(73) Assignee: The United States of America as represented by the Secretary of the Army, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 206 days.

(21) Appl. No.: 09/173,272

(22) Filed: Oct. 15, 1998

(65) Prior Publication Data

US 2001/0013360 A1 Aug. 16, 2001

(51) Int. Cl.[7] ..... E04H 15/40

(52) U.S. Cl. ..... 135/126; 135/128; 135/137; 135/905; 2/89

(58) Field of Search ..... 135/95, 125, 126, 135/123, 143, 116, 906, 905, 137, 128; 2/89

(56) References Cited

U.S. PATENT DOCUMENTS

| | | | | | |
|---|---|---|---|---|---|
| 3,960,161 | A | | 6/1976 | Norman | 135/1 |
| 3,990,463 | A | | 11/1976 | Norman | 135/4 |
| 4,858,634 | A | | 8/1989 | McLeese | 135/104 |
| 5,163,461 | A | | 11/1992 | Ivanovich et al. | 135/104 |
| 5,252,387 | A | * | 10/1993 | Samson et al. | 428/248 |
| D341,407 | S | | 11/1993 | McLeese | D21/253 |
| 5,301,705 | A | * | 4/1994 | Zheng | 135/126 |
| 5,337,772 | A | * | 8/1994 | Habchi | 135/125 |
| 5,343,887 | A | | 9/1994 | Danaher | 135/104 |
| RE35,571 | E | | 7/1997 | McLeese | 135/126 |
| 5,645,096 | A | * | 7/1997 | Hazinski et al. | 135/126 |
| 5,662,372 | A | * | 9/1997 | Lubkeman | 296/136 |

* cited by examiner

*Primary Examiner*—Winnie S. Yip
(74) *Attorney, Agent, or Firm*—Elizabeth Arwine; Charles H. Harris

(57) ABSTRACT

The self-erecting structure has resilient lower and upper support loops which provide it with shape and support. Fabric covers the support loops, and is permanently affixed to the support loops. The fabric has a lower, waterproof portion and an upper insect protection portion. The fabric is preferably treated to provide it with insect repellent and insecticide properties. The support loops are made of flexible, resilient rods made of a material, such as a vinylester and fiberglass combination having a diameter selected to enable the support loops to be folded into six loops, whereby the structure can be compactly stored in a rucksack. The method of folding the structure so that it can be stored in such a compact space is also disclosed.

18 Claims, 5 Drawing Sheets

MULTI-PURPOSE SELF-ERECTING STRUCTURE HAVING ADVANCED INSECT PROTECTION AND STORAGE CHARACTERISTICS

FIELD OF THE INVENTION

The present invention relates generally to a self-erecting structure. In particular the invention relates to a multi-purpose, self-erecting, tent-like structure which has advanced insect protection characteristics and which is specifically adapted for use in both field operations and applications in which insect protection is desired. In preferred embodiments of the invention, components are adapted to provide multiple functions whereby the invention is particularly adapted for military applications.

BACKGROUND OF THE INVENTION

Several types of self-erecting tents and similar structures which rely on two or more springy support loops have heretofore been known. In those structures, the springy support loops were made of a highly resilient material having a good memory. Steel, such as ASTMA 229 steel wire having a range of from 10 gauge to 6 gauge has generally been the material preferably used for forming the support loops in such structures.

U.S. Pat. Nos. 4,458,634 which issued on Aug. 22, 1989, and subsequent Re. 35,571 reissued on Jul. 29, 1997, entitled SELF ERECTING STRUCTURE of E. S. McLeese, the contents of which are herein incorporated by reference, each describe one such structure in which multiple steel loops form the skeletal support framework of a self-erecting tent. As described therein, there are at least two generally elliptical support loops, one of which is a lower support loop configured to lie on the ground, while the other required support loop, referred to herein as the upper support loop is generally "saddle" shaped. Consequently, the lower support loop is substantially coplanar, and it is, therefore, particularly well adapted to lie flat on the ground giving the tent stability. On the other hand, the "ends" of the ellipse which forms the upper support loop are raised off the ground, thereby providing a skeletal framework which supports the tent's fabric above the ground.

Similarly, U.S. Pat. No. Des. 341,407, entitled PORTABLE STRUCTURE issued to E. S. McLeese on Nov. 16, 1993, shows a portable structure having a pair of loop-like members, one of which lies flat on the ground, and the other of which provides a skeleton to give vertical support.

U.S. Pat. No. 5,163,461 entitled SELF-ERECTING SHELTER (the contents of which are also incorporated herein by reference), which issued on Nov. 17, 1992 to M. K. Ivanovich, et al. describes a self-erecting structure similar to those described above wherein the resilient support loops are made of a single, continuous length of steel wire.

The McLeese '634 and '571 patents, and the Ivanovich, et al. patent each describe the benefits of having the resilient loop structure as providing a tent which is self-erecting and in which the fabric of the structure is permanently attached to the support structure. While these designs are capable of virtually instantaneous erection, when they are folded between uses, (although reasonably flat) they are relatively large in size. Consequently, they cannot readily be carried in a rucksack by a soldier. The reason that they are relatively large in size is that the folding system which is taught is compatible with the material (spring steel) from which their support loops is constructed, and it can be folded down into only three loops. Accordingly, a tent structure suitable for use by only a single soldier, having a typical length of about 86 inches and a typical width of from about 30 inches at one end to about 20 inches at the other end, would have a base periphery of about 222 inches (Those skilled in the art will recognize that due to the ovoid, or elliptical, shape of the base support this "rectangularization" of the dimensions is an approximation.). With a base periphery of about 222 inches, when the base is folded into three loops, each loop will have a circumference of about 71 inches, so the three loops which define the size of the stored tent have a diameter of about two feet, which is too large to fit into a soldier's rucksack. Accordingly, while the self-erection feature of these structures is quite desirable, these patents do not teach any way, or material, which would allow them to be folded into a compact size suitable for military field applications. In fact, they each specifically teach a method of folding the tent for storage which requires that they have three loops. As the actual folding of these structures into three flat loops is itself by no means obvious, the teachings of these patents with respect to the folding of the structures for storage is critical to the other teachings in these patents. This becomes self-evident the first time one removes one of these self-erecting structures from its carrying case, erects it, and then attempts to again store it. In fact, even after the tents of this configuration are folded into their storage configuration, they must be restrained using straps or other means, or they will immediately deploy when released. Thus, while materials other than spring steel, such as fiber composites (e.g., graphite and highly flexible plastics) are discussed in the McLeese patents, and while fiberglass and rattan are discussed in the Ivanovich, et al. patent, there is no teaching in either of these patents of any way to minimize the folded, or "storage" size of the tents. Instead, the McLeese and Ivanovich, et al. patents both teach a storage configuration having three loops along with support materials selected to maximize their self-erection characteristic.

U.S. Pat. No. 5,343,887 entitled SELF-ERECTING PORTABLE FABRIC STRUCTURE, which issued on Sep. 6, 1994 to T. C. Danaher describes an elongated structure which uses a series of collapsible hoops, which are oriented vertically, and which are separated horizontally by a series of horizontal spreader members to form a support structure for a self-erecting tent. Due to the configuration of the elements described in the Danaher patent, the horizontal spreader members present a problem in making the tent either fully self-erecting or compact. While there is description within the Danaher patent with respect to folding the collapsible hoops into as many as nine loops, it is not clear from the disclosure how this would be accomplished or how that would matter, given that the storage size of the tent would ultimately depend, also, on the manner of dealing with the horizontal support member. Further, as the vertical support for the tent is based upon the vertically oriented hoops, and as the tent described by Danaher does not have any structural base (as do the structures shown in the McLeese and Ivanovich, et al. patents described above), it is not clear that the tent described in the Danaher patent would not have a tendency to roll on the ground, particularly if the tent was erected on a slope or if windy conditions prevailed.

Thus, while the prior art tents of McLeese and Ivanovich, et al. provide for a fully self-erecting structure, and while they can be stored in relatively compact carrying cases, they are not truly adapted to be carried by a soldier in a rucksack, and while the tent described by Danaher includes hoops which can be folded into relatively small diameters, the horizontal spreader members of that design create a problem when it comes to storage and erection, and the overall design taught by Danaher fails to provide structure having a truly stable base.

Other structures, such as the ones described in U.S. Pat. No. 3,960,161 entitled PORTABLE STRUCTURE which issued on Jun. 1, 1976 to L. R. Norman or in U.S. Pat. No. 3,990,463 also entitled PORTABLE STRUCTURE and issued on Nov. 9, 1976 to L. R. Norman are described as being capable of both self-erection and small storage, but they lack the structural base member needed to provide a well-defined floor and desirable stability when the structure is erected on sloped surfaces, or in windy conditions.

Issues, in addition to ease of erection and storage, and stability on the ground when erected, must also be dealt with in the design of a truly "militarized" protective structure. Thus, the McLeese patents describe different types of webbing, fabric, or tenting materials which may be treated to be suitable for shelter from the elements, or alternatively, to be waterproof, to provide shelter from intense solar radiation, to be insulated and/or reflective, or to prevent the transmission of infrared or other radiation, and/or to inhibit the operation of sensing devices. However, as noted in the McLeese patents, the fact that the fabric is permanently attached to the structural material means that the structure taught therein could exhibit only one of any inconsistent characteristics. Thus, McLeese alternatively teaches a structure which is either waterproof, or comprised of mosquito netting.

Accordingly, while soldiers today may carry both mosquito netting and tent portions (Generally, two soldiers each carry one-half of a military tent, and the two portions are not interchangeable, at that.), they also carry other items, such as rain ponchos, which are not integrated by design. Accordingly, the number of items which they carry, the weight of such items, and an individual soldier's need to rely upon another soldier having a matching tent portion have not been taken into account by presently deployed equipment. Further, other needs of soldiers, such as the need to provide individualized protection from biting insects, such as mosquitoes, both in the field and in beds or cots in field hospitals, have not been directly addressed by the structures or storage methods taught in the prior art.

In view of the foregoing, it would be desirable to have a self-erecting structure which has been designed to provide adaptability for multiple applications which is designed to be capable of forming a fully integrated military solution.

SUMMARY OF THE INVENTION

In accordance with the present invention, a "militarized" self-erecting structure and a novel storage method have been designed to provide numerous advantages over the structures and storage methods heretofore known. In particular, the structure of the present invention is self-erecting, and it utilizes a springy skeletal support structure, preferably including a pair of generally elliptical (or ovoid) loops formed of a material which is both resilient and strong. While these features are described in the prior art, the preferred embodiments of the present invention employ a material, such as a vinyl polyester ("vinylester"), or polyester, and fiberglass composition which is created by pulling fiberglass through a high content vinylester, in a process called "pulltrusion". The resilience and strength qualities of the vinylester fiberglass have been optimized to provide both the self-erection feature previously known, and to enable a novel storage method, not previously known, to be employed whereby a tent having the same overall dimensions as those previously known can now be stored in a carrier having approximately one-half the size of those previously known.

In the preferred embodiment of the present invention, the fabric used on the structure includes two portions, each of which has distinct beneficial qualities, in order to optimize the utility of the structure. In particular, in the preferred embodiment of the invention the floor and lower wall portions are preferably made of a waterproof material, whereas the upper portion of the fabric material is a mesh material which provides protection from insect intrusion.

Further benefits provided in preferred embodiments of the invention are provided by additional features, including camouflage printing on the fabric material, pretreatment of the upper fabric with an insecticide and insect repellent, and pretreatment of the floor and lower wall material to make it repellent to water, as well as an insecticide and an insect repellent.

The present invention is further enhanced by the inclusion of integrated straps which provide a means for holding the structure in its stored configuration. In the deployed configuration, the straps are configured to provide a means for attaching the structure to a bed or cot in a field hospital, whereby the structure is usable to provide insect protection to an occupant who is confined in a field hospital.

An additional feature of exemplary embodiments of the present invention is that it has been designed to optionally use a rain fly which can be removed for use as a rain poncho, thereby providing enhanced functionality of the various components which comprise the invention.

Finally, the present invention includes a novel method for providing storage in which both folds and twists are employed. Accordingly, the present invention can readily be folded into a size approximately significantly smaller than was heretofore possible based upon the storage methods and materials previously used. In particular, in accordance with one embodiment of the storage method taught herein, a tent having fabric which is permanently affixed to a support structure can be folded into either four (or even six) loops, rather than the three loops heretofore taught in the prior art for such tent structures. Consequently, a tent made in accordance with the present invention, and folded in accordance with the inventive method, can readily provide shelter for an individual soldier who could carry the tent in a standard rucksack, something not heretofore possible.

DETAILED DESCRIPTION OF THE PREFERRED EMBODIMENT OF THE INVENTION

Figure 1:
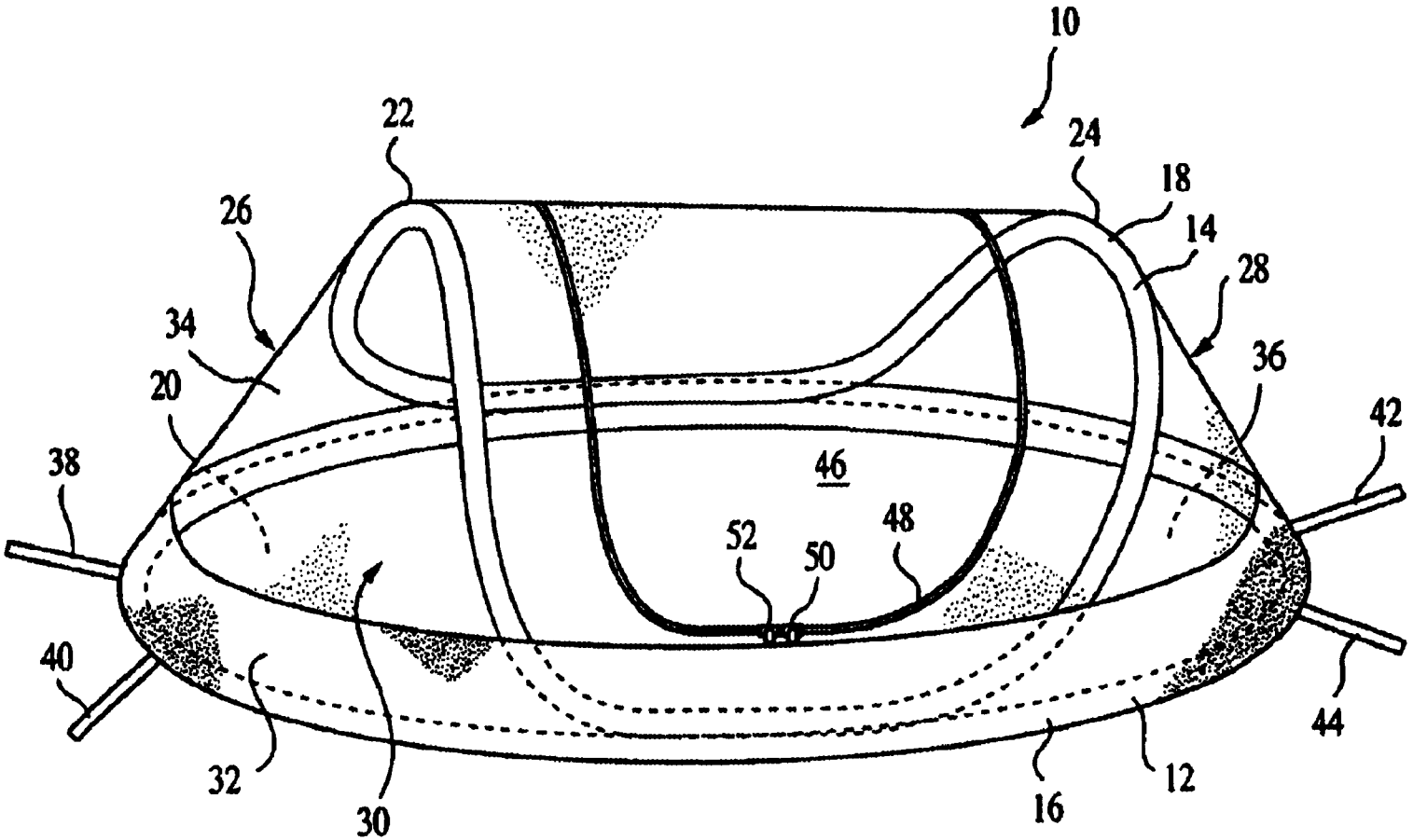
FIG. 1 is a perspective view of the self-erecting structure of the present invention with portions cut away for illustrative purposes.

Referring now to the drawing in which like numerals indicate like parts throughout the several views, FIG. 1 illustrates a partial cutaway view of the self-erecting structure 10 of the present invention. As shown, the structure 10 includes a lower support loop 12 and an upper support loop 14. In the preferred embodiment of the invention the support loops 12, 14 are made of flexible vinylester rods 16, 18 which have a diameter on the order of about 3 mm to about 3.5 mm, with the thinner rods allowing for six loops and the thicker rods allowing for four loops, as will be explained in greater detail hereinafter. The vinylester rods are comprised of a combination of vinylester and fiberglass. If the rods are formulated to have a large fiberglass content they will have greater rigidity, while they will have greater flexibility if they are formulated to have less glass content. Accordingly, those skilled in the art will recognize that the specific rod diameter used in the preferred embodiment of the invention is subject to change based upon the formulation of the material making up the rod, and they will recognize that other formulations and diameters can be used for the rods 16, 18 to accomplish the results taught herein. In particular, as will be further described hereinafter, the use of the highly resilient rods 16, 18 in the structure 10 allows the loops 12, 14 to be folded and twisted, as described hereinafter, into more than the three loops heretofore known in self-erecting structures having a lower support loop, such as the lower support loop 12 of the present invention.

With continued reference to FIG. 1, the lower support loop 12 forms the base 20 of the structure 10, and all portions of the lower support loop 12 lie substantially in a single plane. The springiness of the lower support loop 12 serves to hold the base 20 open, flat, and in contact with the ground when the structure 10 is erect. The upper support loop 14 has opposed ends 22, 24 which are bent upward away from the base 20. In the preferred embodiment of the invention, the structure 10 is somewhat wider and higher at one end 26, herein referred to as the "head" end 26, and it is somewhat narrower and lower at the opposed foot end 28. In the preferred embodiment 10, the end 22 adjacent the head end 26 is approximately 26 inches high, while the end 24 adjacent the foot end 28 is approximately 18 inches high. Similarly, the base 20 is about 30 inches wide near the head end 26, while it is only about 20 inches wide near the foot end 28.

The structure 10 includes preferably includes a permanently affixed fabric shell 30 comprised of a lower fabric portion 32 and an upper fabric portion 34. In the preferred embodiment 10, the lower fabric portion 32 is preferably comprised of a material, such as a Nylon taffeta, which has been treated to make it highly water resistant. In the preferred embodiment of the invention the fabric is 190 count, 70 denier, and it meets CPA184 fire retardant standards, and it has a water repellent coating which exceeds 800 mm hydrostatic tests. If additional strength is desired a rip stop Nylon can be used. This material forms the floor 36 of the structure 10, and it extends about six inches upward from the lower support loop 12 around the periphery of the structure 10. Accordingly, the lower fabric portion 32 prevents ground moisture from entering the structure 10 when it is on the ground.

The upper fabric portion 34 is preferably formed of a mesh material having approximately 1024 openings per square inch, with the openings having a size and configuration which are of a size which is too small to allow the passage of insects, but large enough to allow for ample ventilation to one who is inside the structure 10. The material comprising the upper fabric portion 34 of the preferred embodiment is impregnated with an insect repellent called "No-See-Um" which is manufactured by Alwyn Company, Inc. of Minnesota to further provide protection from insects to the occupant.

The structure 10 of the preferred embodiment also includes straps 38, 40, 42, 44 which serve multiple functions. When the structure 10 is on the ground the straps 38, 40, 42, 44 may be used with stakes to act as tie-downs to help secure the structure 10 in position. When the structure 10 is used on a bed or cot in a field hospital, the straps 38, 40, 42, 44 may be used to secure the structure 10 to the bed or cot. Finally, the straps 38, 40, 42, 44 are also used when the structure 10 is folded (as will be hereinafter described), to secure the structure 10 in the folded state thereby preventing it from inadvertently self-erecting.

In order to provide ingress and egress, a door 46 is provided in one side of the structure 10. The door 46 is formed by a zippered opening 48 formed in the side of the structure. Preferably, a pair of zipper sliders 50, 52, operable from either inside or outside of the structure 10, allow the door 46 to be opened or secured shut.

Figure 2:
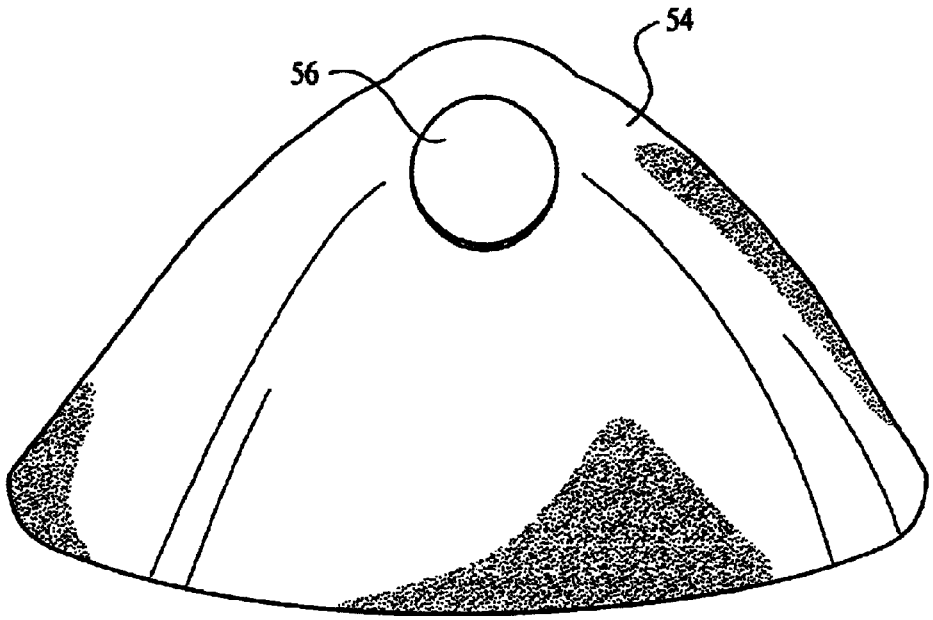
FIG. 2 is a perspective view of the combined rain fly and poncho which is used to convert the structure of FIG. 1 into a tent.

While the structure 10, as described thus far serves to provide insect protection, and is suitable for use in appropriate weather and temperature conditions, there are times when additional protection is desirable. Accordingly, with reference to FIG. 2, a rain fly 54 has been designed to fit over the structure 10. The rain fly 54 is preferably made of Nylon taffeta, or other suitable material, which has been treated to render it substantially water resistant. As shown, the rain fly 54 includes a hood opening 56 which may be positioned over the structure 10 so as to assure that the occupant has adequate ventilation. In order to prevent rain from entering the hood opening 56, it is preferably positioned over the structure 10 with the hood opening 56 facing down. A unique feature of the rain fly 54 is that when it is removed from the structure 10 its shape and configuration allow it to be used, also, as a poncho.

Figure 12:
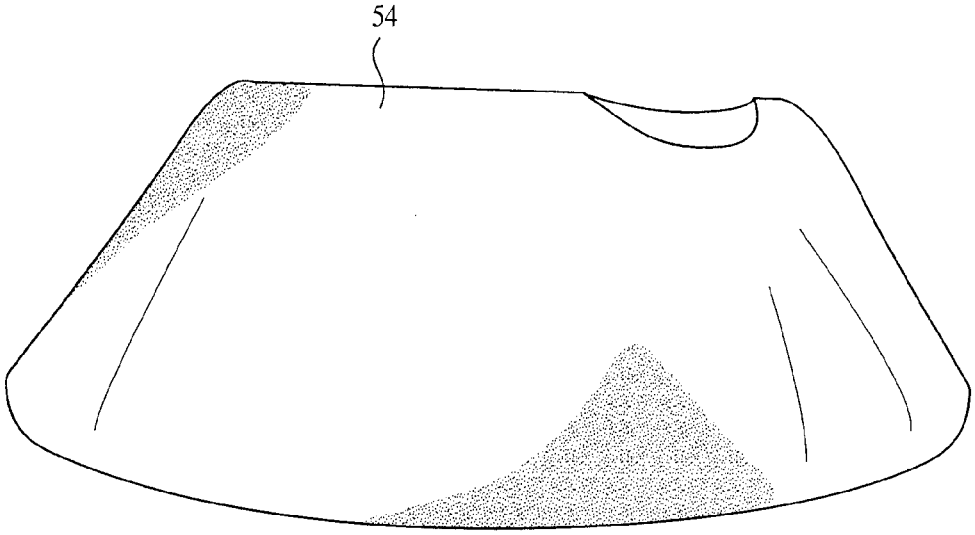
FIG. 12 shows the rain fly on the self-erecting structure.
Figure 13:
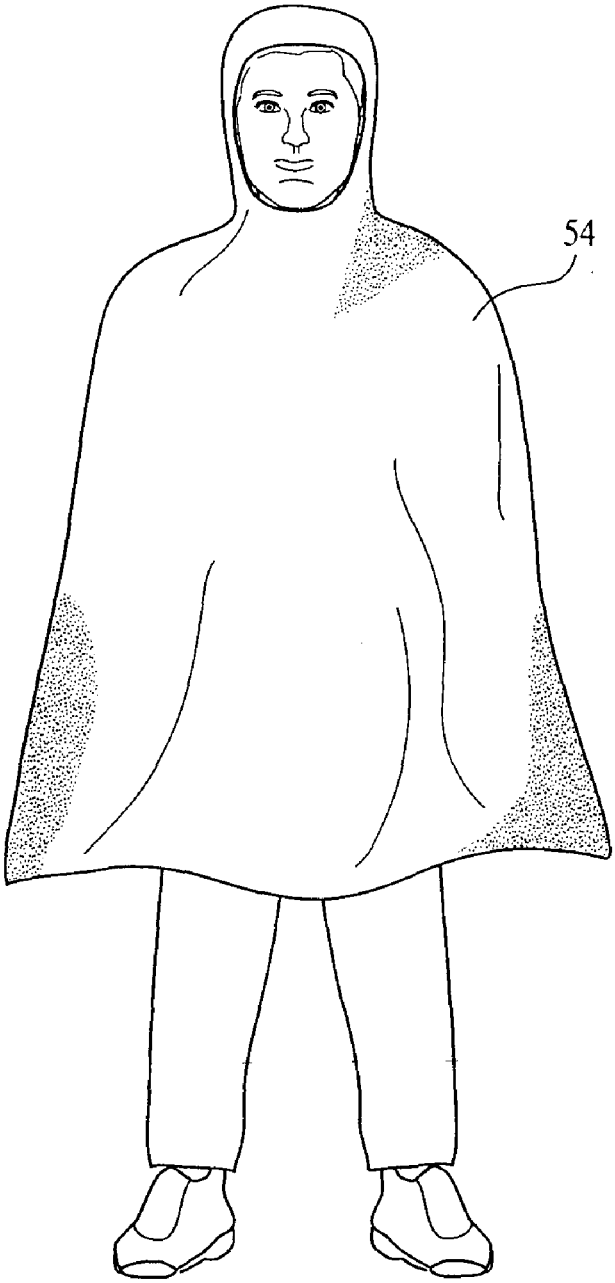
FIG. 13 shows the rain fly being worn as a poncho by a person.

Referring to FIG. 12, the rain fly 54 is shown on the self-erecting structure, while in FIG. 13, the rain fly is shown being worn as a poncho.

As described, the structure 10 of the preferred embodiment of the present invention includes a number of features not heretofore known which interact synergistically so as to provide a soldier with a single unit having features which were present only when a number of items of the prior art were combined. Thus, a soldier using the structure 10 of the present invention has insect protection (both in the field, and, if necessary, for use on a cot or bed in a field hospital), and a rain fly 54, which can double as a poncho. Thus, the soldier can have, in one unit which fits easily into his rucksack, and which weighs approximately three pounds, all of the equipment and protection which he formerly had in a package weighing approximately nine pounds, yet which failed to provide the functionality or protection of the present invention.

As will be understood by those skilled in the art, the fabric of the structure 10, and the rain fly 54 are preferably printed with an appropriate camouflage, such as a "woodlands" or "desert" camouflage.

Figure 3:
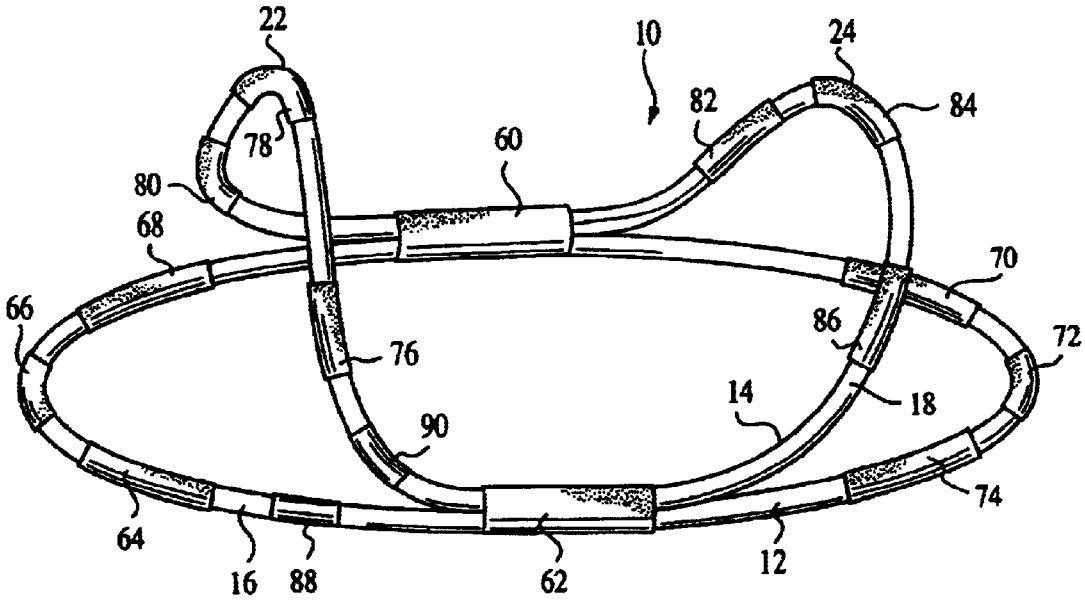
FIG. 3 is a perspective view of the upper and lower support loops which are used in the structure of FIG. 1, together with the guide sleeves used to form the shapes of the support loops and the ferrules which form the rods into loops.

Referring now to FIG. 3, the structure 10 of FIG. 1 is illustrated with the fabric portions removed. Accordingly, the lower support loop 12 and the upper support loop 14 of the structure 10 are clearly illustrated. As shown, the loops 12, 14 are held together by elongated guide sleeves 60, 62, which the rods 16, 18 which form the lower and upper support loops 12, 14 pass through. These guide sleeves 60, 62 are preferably formed of the same Nylon taffeta fabric which forms the lower fabric portion 32. Similarly, the rod 16 which forms the lower support loop passes through other guide sleeves 64, 66, 68, 70, 72, 74 formed of the same material. All of these guide sleeves 60, 62, 64, 66, 68, 70, 72, 74 are preferably sewed to the lower fabric portion 32 (not shown). The rod 18 which forms the upper support loop 14 passes through guide sleeves 60, 62, 76, 78, 80, 82, 84, 86, which are also preferably formed of the same material as the lower fabric portion 32 (not shown), as it is stronger than the material of which the upper fabric portion 34 (not shown) is formed. The guide sleeves 76, 78, 80, 82, 84, 86 are preferably sewed to the upper fabric portion 34 which is shown in FIG. 1. Collectively, these guide sleeves 60–86 provide the lower and upper support loops 12, 14 with their shapes, and they provide the structure 10 with its shape and support.

With continued reference to FIG. 3, a pair of ferrules 88, 90 are illustrated. In the preferred embodiment of the invention, these ferrules 88, 90 are made of metal, and they are used to join the ends of the rods 16, 18, respectively. In the manufacture of the structure 10, one end of the rod 16 is threaded through the guide sleeves 64, 66, 68, 60, 70, 72, 74, 62. The ferrule 88 is filled with epoxy, and then the two ends of the rod 16 are inserted therein to form the lower support loop 12. Similarly, one end of the rod 18 is threaded through the guide sleeves 76, 78, 80, 60, 82, 84, 86, 62. Then the ferrule 90 is filled with epoxy, and then the two ends of the rod 18 are inserted therein to form the upper support loop 14.

While the invention has been described as having a pair of rods 16, 18, each of which corresponds to one of the support loops 12, 14, respectively, it will be understood by those skilled in the art that a single rod could be used to form both of the support loops in a manner similar to that described in the aforementioned patent to Ivanovich, et al. In such instance, a single rod would be threaded through the various guide sleeves, and its ends would be joined by a single ferrule. Thus (with continued reference to FIG. 3), a rod could be threaded through guide sleeves 64, 66, 68, 60, 82, 84, 86, 62, 76, 78, 80, 60, 70, 72, 74, 62, and then joined by ferrule 88, in which case there would be no need for ferrule 90.

Referring now to FIGS. 4–8, a first embodiment of the inventive manner of folding the structure 10 of FIG. 1 is illustrated. In order to simplify the description of the method, the upper and lower support loops 12, 14 will be regarded as a single loop 100, as the first step in the method involves bringing the "foot" portion of the lower support loop 12 together with the "foot" portion of the upper support loop 14, while also bringing the "head" portion of the lower support loop together 12 with the "head" portion of the upper support loop 14 (See FIG. 1), thereby forming two overlying loops which are referenced as loop 100, having a head end 102 and a foot end 104, in the description which follows. The relevance of identifying the head end 102 and foot end 104 in the description of the new storage methods is that in the actual pair of joined support loops 12, 14, the loops 12, 14 can be separated at their "head" and "foot" ends, but not in between, as they are joined by the guide sleeves 60, 62 (See FIG. 3).

Figure 4:
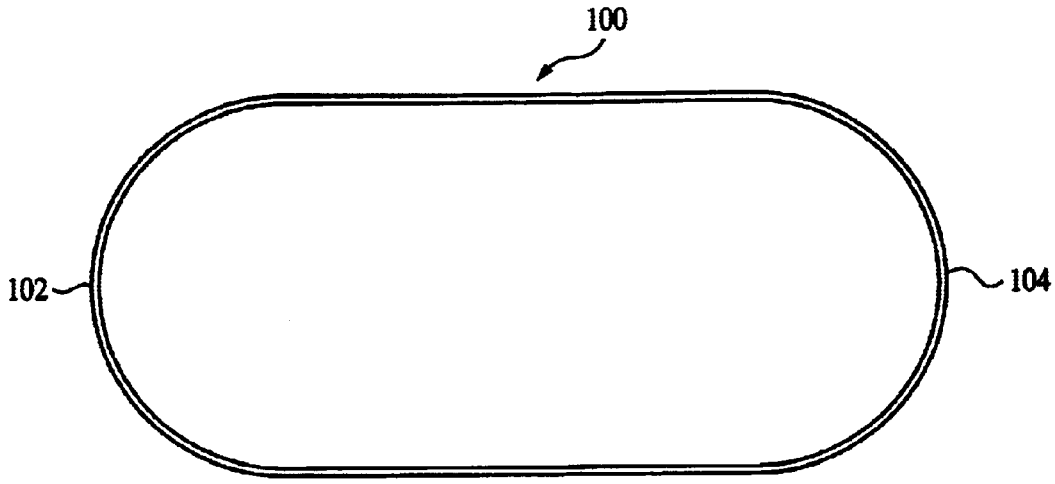
FIGS. 4–8 illustrate a first inventive method of storing the structure of the present invention which provides a twenty-five percent improvement in size (e.g., loop diameter) over the method known in the prior art.

As shown in FIG. 4, the new method comprises the steps of first bringing the ends of the support loops 12, 14 together to form a single loop 100, having head end 102 and foot end 104.

Figure 5:
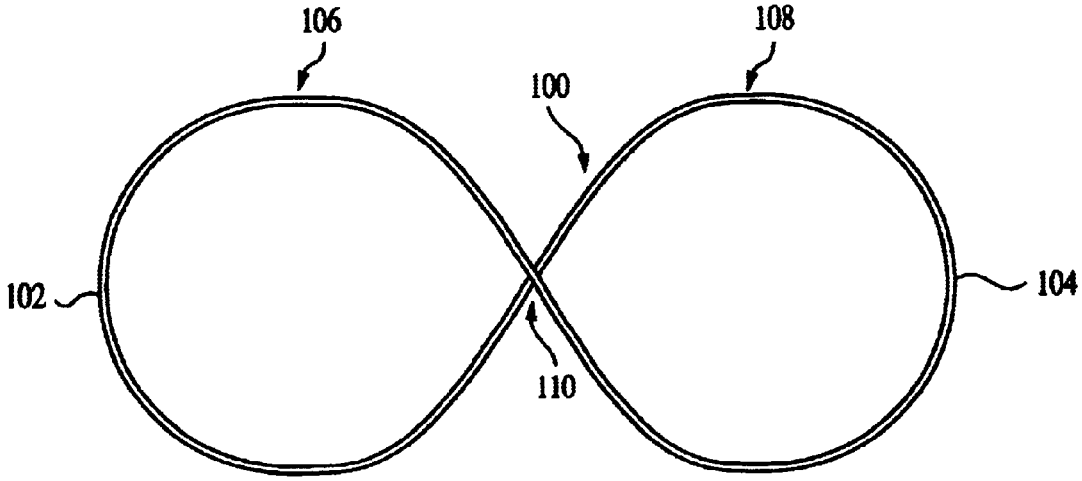
Figure 6:
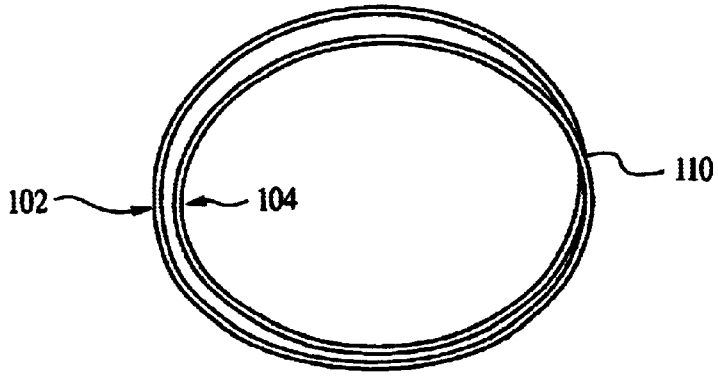

Next, as shown in FIG. 5, the head end 102 is twisted 180 degrees relative to the foot end 104, whereby a "figure eight" having two loops 106, 108, and an intersection 110, is formed. Then, the foot end 104 is brought over the intersection 110, so as to bring the foot end 104 to the head end 102, as shown in FIG. 6, thereby causing the two loops 106, 108 to become concentric.

Figure 7:
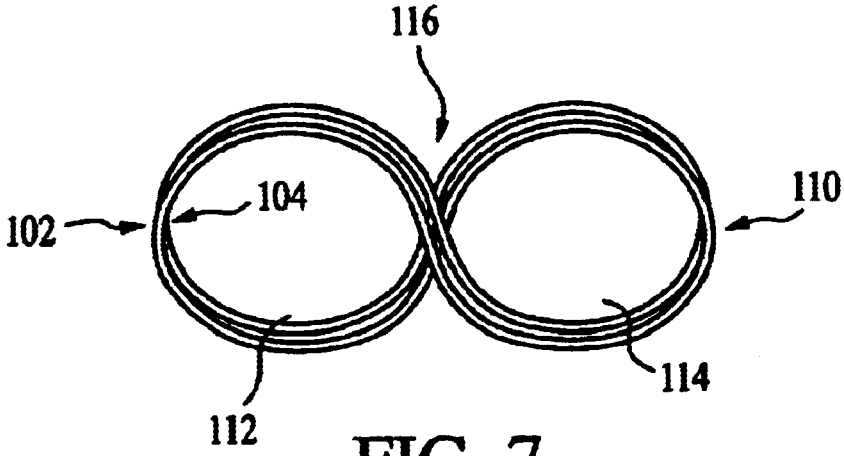

With reference to FIG. 7, the head and foot ends 102, 104 are next twisted 180 degrees relative to the intersection 110, thereby forming a second, doubled "figure eight" having double loops 112, 114, and doubled intersection 116.

Figure 8:
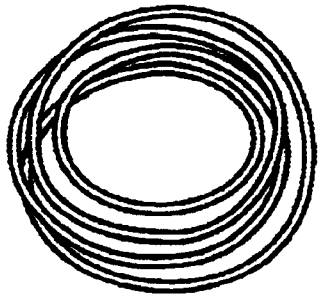

Finally, the double loop 114 which includes the first intersection 110 is brought over the doubled intersection 116, thereby causing the two sets of double loops 112, 114 to become concentric as shown in FIG. 8. As illustrated, there will be four concentric loops, which will reduce their diameter from about twenty-four inches to about eighteen inches, given the structure size mentioned above.

Alternatively, if an even smaller package size is desired, as will be the case when the structure 10 is intended to be kept in a soldier's rucksack, one may follow the new method steps set forth in FIGS. 4–6 and 9–11.

Figure 9:
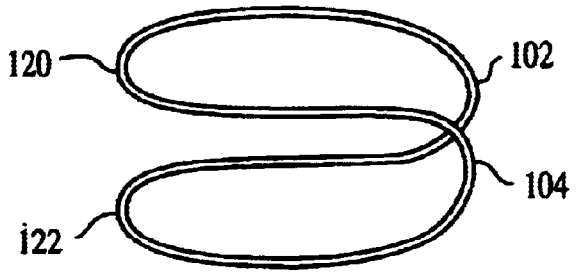
FIGS. 9–11 illustrate a second inventive method of storing the structure of the present invention which provides a fifty percent improvement in size (e.g., loop diameter) over the method known in the prior art.
Figure 10:
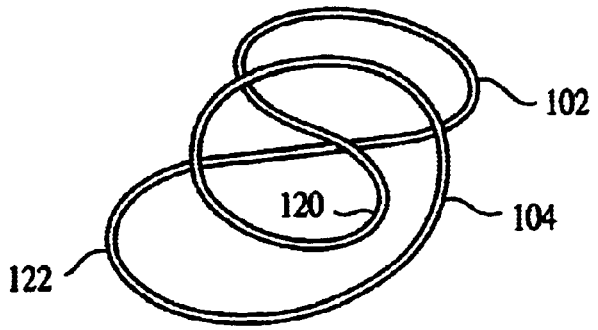
Figure 11:
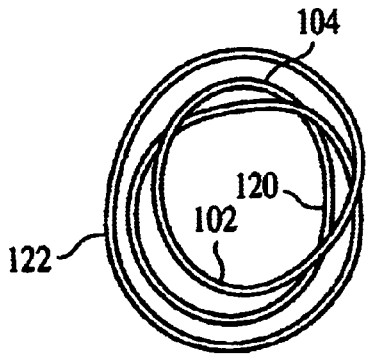

As shown in FIG. 9, the ends 102, 104 (of FIG. 4) are brought together, and then turned on their side, leaving an upper half-loop having an "end" 120 and a lower half-loop having an "end" 122. The end 120 is brought around and under, as shown in FIG. 10, and as known in the methods of the prior art (See FIG. 10), and still in accordance with the prior art methods three concentric rings are formed, as shown in FIG. 11. For simplicity, these three concentric rings can be regarded as a single ring, such as the single ring 100, as shown in FIG. 4. Following the steps outlined above in FIGS. 4–6, the three rings (illustrated as a single ring 100) are first twisted 180 degrees to form a pair of triple-concentric loops (such as the loops 106, 108 of FIG. 5) with an intersection 110 therebetween. the triple concentric loops are brought together over the intersection 110, as shown in FIG. 6, thereby leaving six concentric loops having a diameter of about twelve inches for the structure 10 described above. Due to the size and resilience of the material used to form the rods used in the present invention, the novel "twist and bend" method presented herein provides a loop diameter which is one-half that known in the prior art. Further, the rod material may be further "squeezed" to make it even narrower (though somewhat longer) whereby it will readily fit within a soldier's rucksack.

As illustrated herein, the new structure and associated novel method of storage provide features not heretofore available in the known art. As such, a soldier no longer needs to carry partial equipment, such as the half-shelter, or redundant equipment, such as a poncho and a rain fly. Nevertheless, the present invention provides the soldier with the additional benefit of a self-erecting structure which can provide insect protection either in the field, or in a cot in a field hospital, features not available in the prior art. Further, due to the materials used herein, and the novel "twist and bend" storage method, the structure of the present invention fits into a rucksack. Notwithstanding all of these advantages over the known apparatus, the overall weight which the soldier must carry is about one-third that which he previously had to carry.

We claim:

1. A self-erecting structure of the type comprising:

(a) a first continuous, resilient, closed substantially planar lower support loop member, said lower support loop member being adapted to contact a surface upon which the structure will rest when the structure is erected;

(b) a second continuous, resilient, closed upper support loop member secured to the closed loop lower support member at at least two points; and (c) a fabric membrane extending around and enclosing said lower support loop member and said upper support loop member with portions of said upper support loop member being formed to position said portions apart from and above said lower support loop member, whereby said fabric membrane is formed into walls and a roof for said structure, said walls including an entry port for defining an enclosure within said fabric positioned around said support loop members, said upper support loop member supporting said walls and said roof, the improvement comprising said resilient loop members being comprised of at least one rod made of a material having a resilience and diameter such that said loop members can be folded into six concentric loops for storage purposes.

2. The structure of claim 1, wherein the material of which said at least one rod is made is vinyl polyester and fiberglass.

3. The structure of claim 1 wherein said six concentric loops have a diameter of about twelve inches.

4. The structure of claim 3, wherein said at least one rod has a diameter of about 3 mm.

5. The structure of claim 1, having two rods, wherein each of said support loop members includes a separate rod.

6. The structure of claim 1, wherein a single rod is used to form both of said support loop members.

7. The structure of claim 1, wherein said fabric membrane is comprised of a lower fabric portion which forms the floor of said structure and an upper fabric portion which substantially forms the remainder of said fabric membrane, said lower fabric portion being comprised of water resistant material.

8. The structure of claim 7, wherein said lower fabric portion extends part way up from said floor to form a wall, whereby water is prevented from entering said structure at least up to the height of said wall.

9. The structure of claim 8, wherein said upper fabric portion is comprised of a fabric which is substantially impermeable to insects.

10. The structure of claim 9, wherein said upper fabric portion is treated with an insect repellent substance.

11. The structure of claim 10, wherein said lower fabric portion is treated with an insect repellant substance.

12. The structure of claim 7, wherein said lower fabric portion is treated with an insect repellant substance.

13. The structure of claim 7, wherein said lower fabric portion is treated with a water repellant substance.

14. The structure of claim 1, wherein said structure is sized to fit on top of a cot of the type used in a field hospital, and wherein said structure further comprises straps which are adapted to hold said structure to said cot.

15. The structure of claim 1, further comprising a water repellant rain fly placed over the upper portion of said structure.

16. The structure of claim 15, wherein said rain fly includes an opening which is adapted to provide adequate ventilation to an occupant of said structure when said rain fly is affixed thereto and said structure is occupied.

17. The structure of claim 1 wherein said entry port is disposed in a longitudinal side of said structure and above ground level.

18. A self-erecting structure of the type comprising:

(a) a first continuous, resilient, closed substantially planar lower support loop member, said lower support loop member being adapted to contact a surface upon which the structure will rest when the structure is erected;

(b) a second continuous, resilient, closed upper support loop member secured to the closed loop lower support member at at least two points; and (c) a fabric membrane extending around and enclosing said lower support loop member and said upper support loop member with portions of said upper support loop member being formed to position said portions apart from and above said lower support loop member, whereby said fabric membrane is formed into walls and a roof for said structure, said walls including an entry port for defining an enclosure within said fabric positioned around said support loop members, said upper support loop member supporting said walls and said roof, the improvement comprising said resilient loop members being comprised of at least one rod made of a material having a resilience and diameter such that said loop members can be folded into six concentric loops for storage purposes;

the self-erecting structure further comprising a water repellant rain fly placed over the upper portion of said structure wherein said rain fly includes an opening which is adapted to provide adequate ventilation to an occupant of said structure when said rain fly is affixed thereto and said structure is occupied; and further wherein said rain fly is configured so as to allow an individual to use said rain fly as a rain poncho, and said opening is configured to allow the head of an individual to use such opening and surrounding material as a hood, whereby said rain fly can act as a rain poncho for an individual.

* * * * *

UNITED STATES PATENT AND TRADEMARK OFFICE

CERTIFICATE OF CORRECTION

Figure 14:
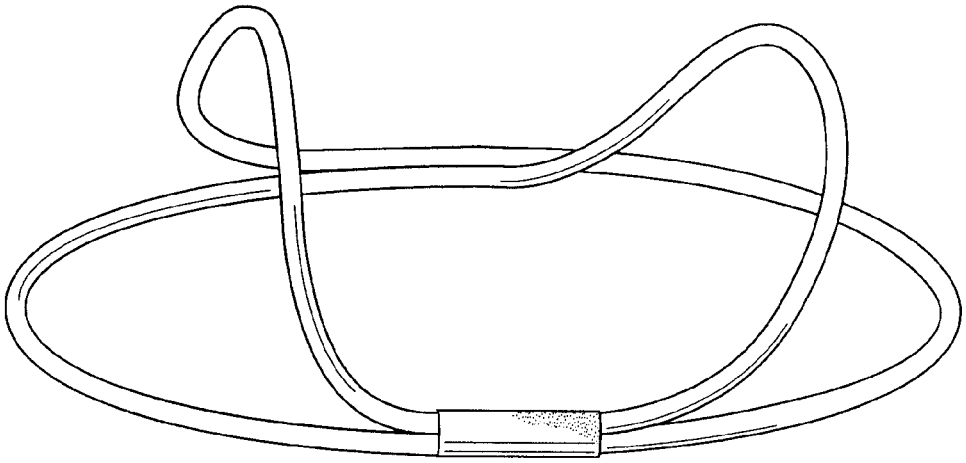
FIG. 14 shows the self-erecting structure using a single rod to form both of the support loop members.
Figure 1:
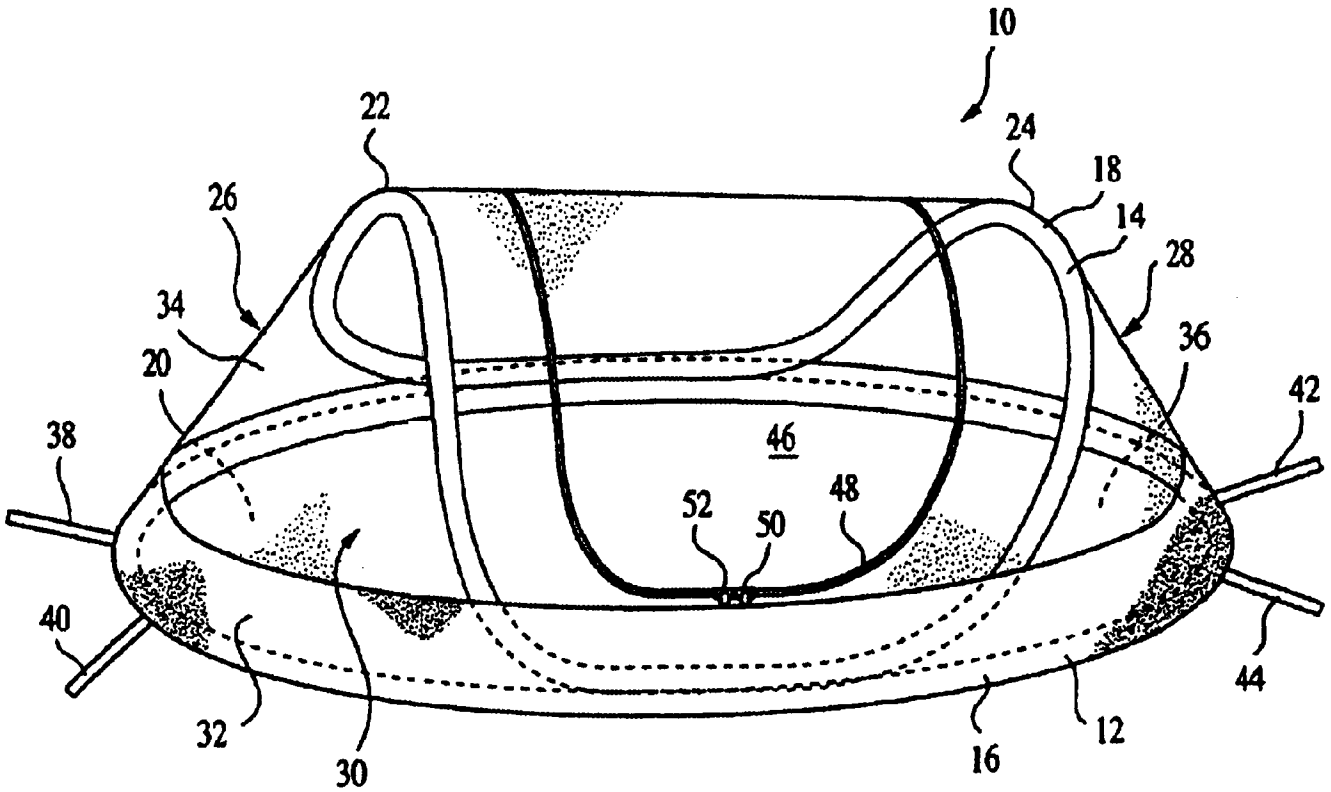
Figure 2:
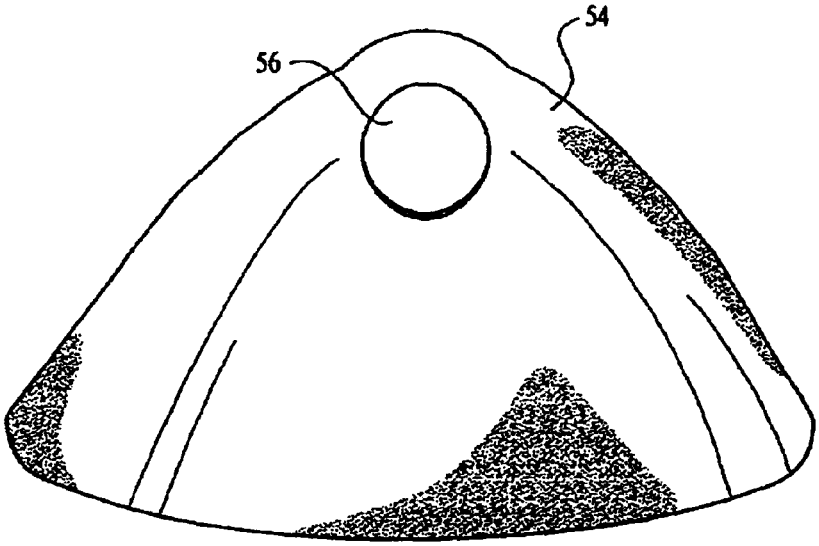
Figure 3:
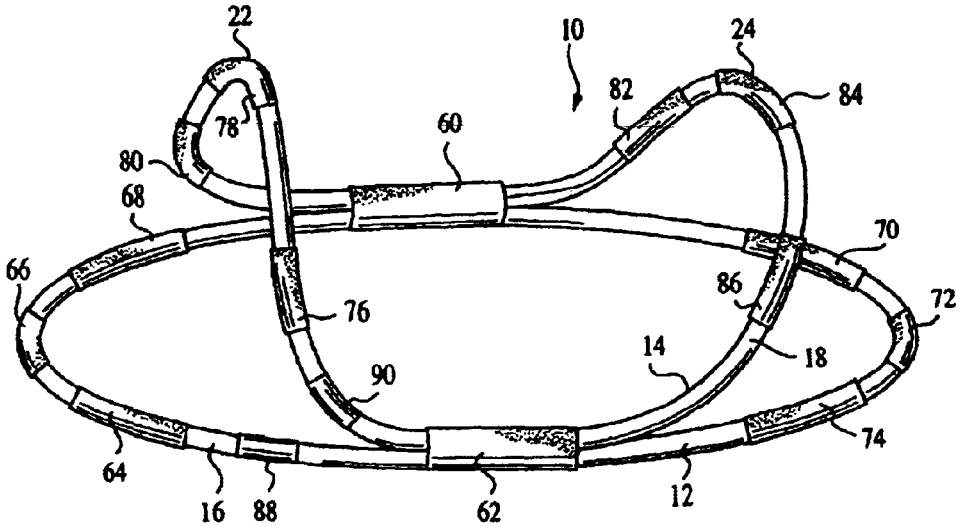
Figure 4:
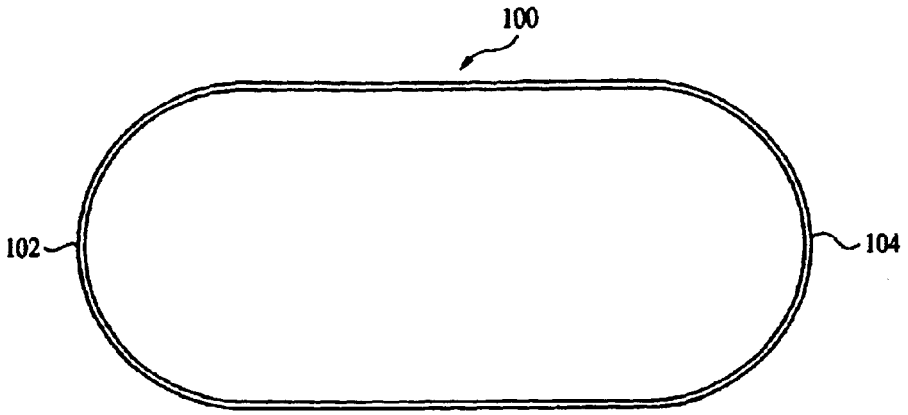
Figure 5:
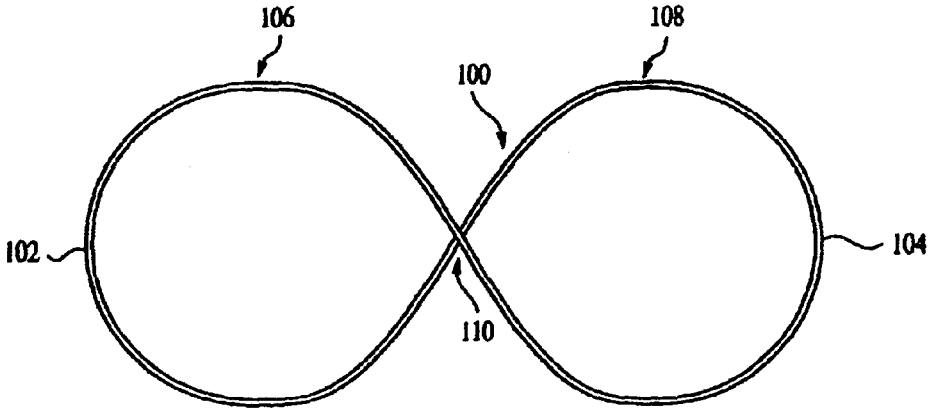
Figure 6:
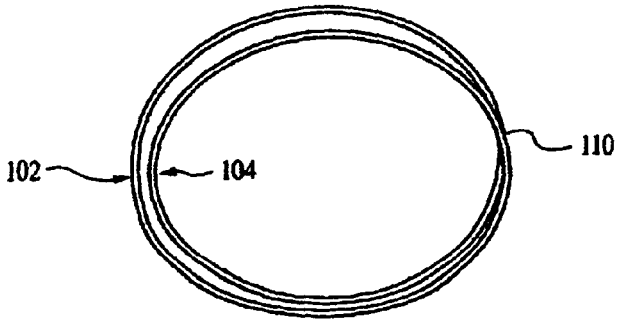
Figure 7:
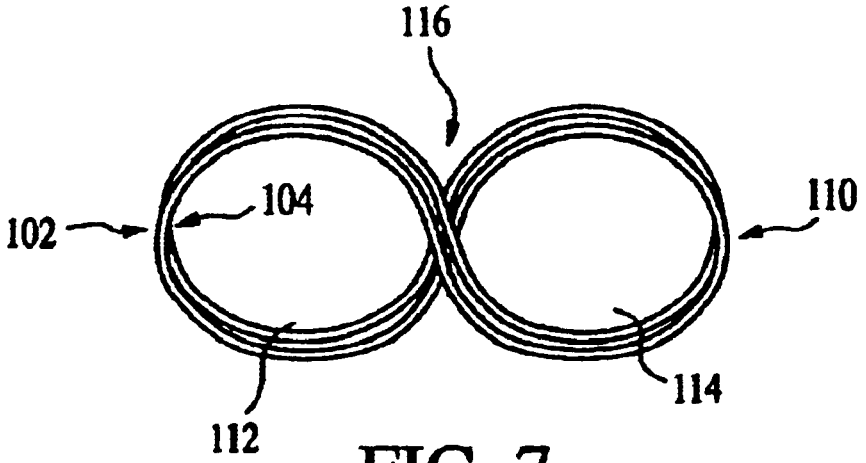
Figure 8:
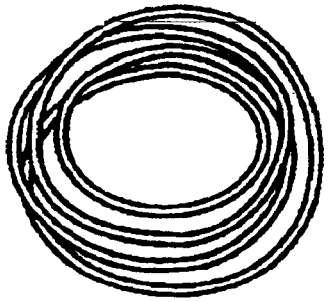
Figure 9:
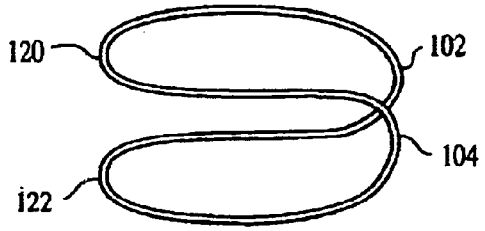
Figure 10:
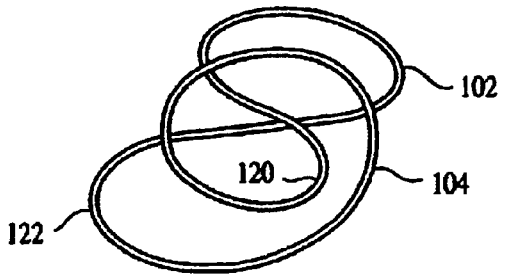
Figure 11:
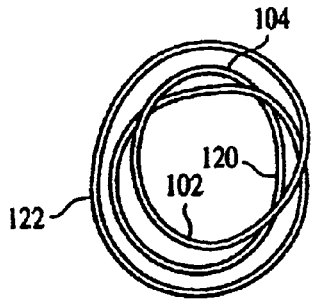
Figure 12:
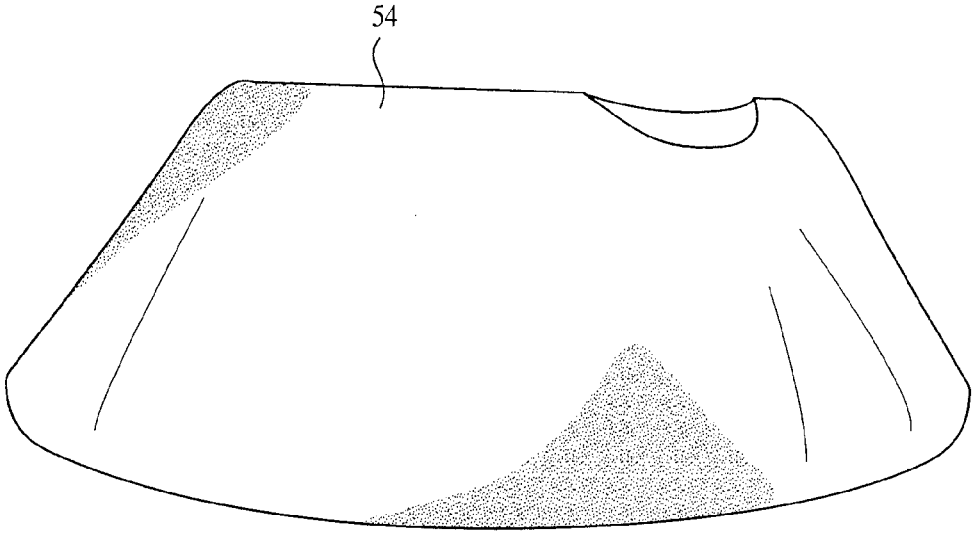
Figure 14:
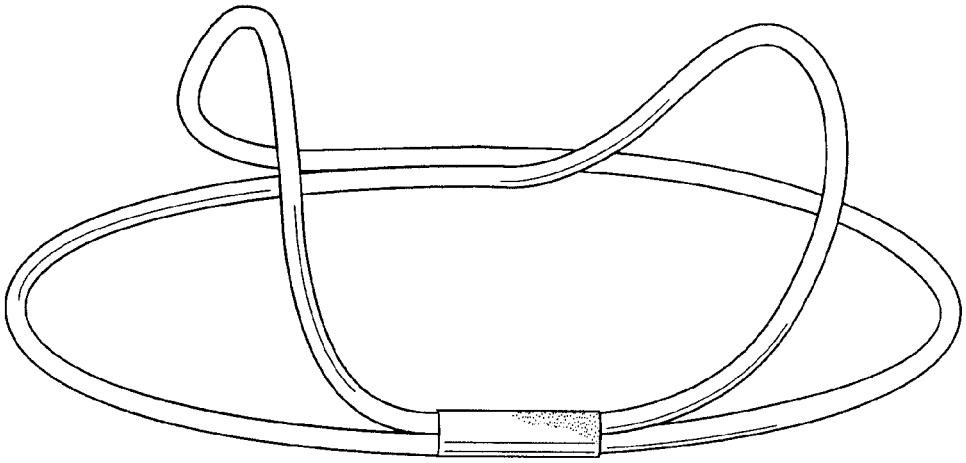

PATENT NO. : 6,672,323 B2 
DATED : January 6, 2004
INVENTOR(S) : Raj Kumar Gupta and Young Woo Yoon It is certified that error appears in the above-identified patent and that said Letters Patent is hereby corrected as shown below:

Drawings,
Add Figs 12-14 as attached.

Signed and Sealed this

Twenty-seventh Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,672,323 B2 
DATED : January 6, 2004
INVENTOR(S) : Raj Kumar Gupta and Young Woo Yoon It is certified that error appears in the above-identified patent and that said Letters Patent is hereby corrected as shown below:

Delete the title page and substitute therefor the attached title page.

Delete Drawings sheets 1-5 and substitute therefor the attached Drawing sheets 1-7.

Signed and Sealed this

Twenty-first Day of September, 2004

JON W. DUDAS
*Director of the United States Patent and Trademark Office*

(12) United States Patent
Gupta et al.

(10) Patent No.: US 6,672,323 B2
(45) **Date of Patent: *Jan. 6, 2004**

(54) MULTI-PURPOSE SELF-ERECTING STRUCTURE HAVING ADVANCED INSECT PROTECTION AND STORAGE CHARACTERISTICS

(75) Inventors: Raj Kumar Gupta, Walkersville, MD (US); Young Woo Yoon, Glenview, IL (US)

(73) Assignee: The United States of America as represented by the Secretary of the Army, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 206 days.

(21) Appl. No.: 09/173,272

(22) Filed: Oct. 15, 1998

(65) Prior Publication Data

US 2001/0013360 A1 Aug. 16, 2001

(51) Int. Cl.[7] ..... E04H 15/40

(52) U.S. Cl. ..... 135/126; 135/128; 135/137; 135/905; 2/89

(58) Field of Search ..... 135/95, 125, 126, 135/123, 143, 116, 906, 905, 137, 128; 2/89

(56) References Cited

U.S. PATENT DOCUMENTS

| | | | | | |
|---|---|---|---|---|---|
| 3,960,161 | A | | 6/1976 | Norman | 135/1 |
| 3,990,463 | A | | 11/1976 | Norman | 135/4 |
| 4,858,634 | A | | 8/1989 | McLeese | 135/104 |
| 5,163,461 | A | | 11/1992 | Ivanovich et al. | 135/104 |
| 5,252,387 | A | * | 10/1993 | Samson et al. | 428/248 |
| D341,407 | S | | 11/1993 | McLeese | D21/253 |
| 5,301,705 | A | * | 4/1994 | Zheng | 135/126 |
| 5,337,772 | A | * | 8/1994 | Habchi | 135/125 |
| 5,343,887 | A | | 9/1994 | Danaher | 135/104 |
| RE35,571 | E | | 7/1997 | McLeese | 135/126 |
| 5,645,096 | A | * | 7/1997 | Hazinski et al. | 135/126 |
| 5,662,372 | A | * | 9/1997 | Lubkeman | 296/136 |

* cited by examiner

*Primary Examiner*—Winnie S. Yip
(74) *Attorney, Agent, or Firm*—Elizabeth Arwine; Charles H. Harris

(57) ABSTRACT

The self-erecting structure has resilient lower and upper support loops which provide it with shape and support. Fabric covers the support loops, and is permanently affixed to the support loops. The fabric has a lower, waterproof portion and an upper insect protection portion. The fabric is preferably treated to provide it with insect repellent and insecticide properties. The support loops are made of flexible, resilient rods made of a material, such as a vinylester and fiberglass combination having a diameter selected to enable the support loops to be folded into six loops, whereby the structure can be compactly stored in a rucksack. The method of folding the structure so that it can be stored in such a compact space is also disclosed.

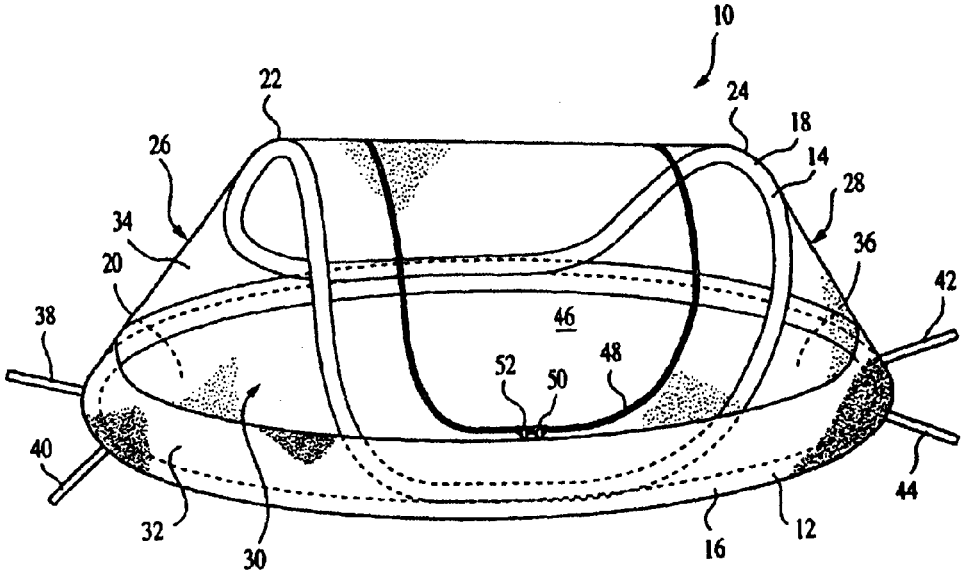

18 Claims, 7 Drawing Sheets